US011045856B2

(12) United States Patent
Rukat

(10) Patent No.: US 11,045,856 B2
(45) Date of Patent: Jun. 29, 2021

(54) REDRAW SLEEVE ASSEMBLY

(71) Applicant: CROWN PACKAGING TECHNOLOGY, INC., Alsip, IL (US)

(72) Inventor: Bronislaw Rukat, West Yorkshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 277 days.

(21) Appl. No.: 16/318,892

(22) PCT Filed: Jul. 3, 2017

(86) PCT No.: PCT/GB2017/051951

§ 371 (c)(1),
(2) Date: Jan. 18, 2019

(87) PCT Pub. No.: WO2018/020208

PCT Pub. Date: Feb. 1, 2018

(65) Prior Publication Data

US 2019/0255588 A1 Aug. 22, 2019

(30) Foreign Application Priority Data

Jul. 28, 2016 (GB) ..... 1613055

(51) Int. Cl.
*B21D 22/28* (2006.01)
*B21D 22/30* (2006.01)

(52) U.S. Cl.
CPC ..... *B21D 22/283* (2013.01); *B21D 22/28* (2013.01); *B21D 22/30* (2013.01)

(58) Field of Classification Search
CPC ..... B21D 22/283; B21D 22/28; B21D 22/24; B21D 51/26
USPC ..... 72/347–349
See application file for complete search history.

(56) References Cited

U.S. PATENT DOCUMENTS 4,193,279 A 3/1980 Maeder
4,702,098 A * 10/1987 Pora ..... B21D 24/08 72/347
5,212,977 A * 5/1993 Stuart ..... B21D 22/30 72/347

(Continued)

FOREIGN PATENT DOCUMENTS

CN 103687680 A 3/2014
JP S5899706 A 6/1983
WO WO 99/34942 A1 7/1999

*Primary Examiner* — Adam J Eiseman
*Assistant Examiner* — Bobby Yeonjin Kim
(74) *Attorney, Agent, or Firm* — BakerHostetler

(57) ABSTRACT

A can bodymaker comprising a ram and a redraw sleeve assembly for holding a cup or other preform article against a redraw die. The redraw sleeve assembly comprises: a redraw sleeve; a redraw carriage to which the redraw sleeve is removably coupled, the redraw carriage being driven in a reciprocating motion along an axis; and a redraw sleeve alignment mechanism. The redraw sleeve alignment mechanism comprises: a redraw sleeve module having one or more bearings defining a passage through which the redraw sleeve moves and a bearing adjustment mechanism to facilitate radial alignment of the redraw sleeve module with the redraw die. The coupling between the redraw carriage and the redraw sleeve permits variable radial offset, relative to said axis, between the two components.

18 Claims, 6 Drawing Sheets

(56) References Cited

U.S. PATENT DOCUMENTS

| | | | | | |
|---|---|---|---|---|---|
| 5,249,448 | A | | 10/1993 | Fedor et al. | |
| 5,271,259 | A | | 12/1993 | Miller et al. | |
| 5,357,779 | A | * | 10/1994 | Hahn | B21D 22/28 72/347 |
| 5,454,253 | A | * | 10/1995 | Mueller | B21D 22/28 72/349 |
| 5,691,582 | A | * | 11/1997 | Lucas | B21D 51/26 310/14 |
| 5,775,160 | A | * | 7/1998 | Fleischer | B21D 22/28 72/349 |
| 2014/0260499 | A1 | | 9/2014 | Fowler et al. | |
| 2015/0059429 | A1 | | 3/2015 | Butcher et al. | |

* cited by examiner

REDRAW SLEEVE ASSEMBLY

CROSS-REFERENCE TO RELATED APPLICATIONS

This application is the National Stage of International Application No. PCT/GB2017/051951 filed Jul. 3, 2017, which claims the benefit of GB application number 1613055.1, filed Jul. 28, 2016, the disclosures of which are incorporated herein by reference in their entirety.

TECHNICAL FIELD

The present invention relates to a can bodymaker and in particular to a can bodymaker comprising a redraw sleeve assembly. The invention also relates to a redraw sleeve alignment mechanism and a toolpack module incorporating a redraw sleeve alignment mechanism for use with a can bodymaker and to a method of setting up a can bodymaker.

BACKGROUND

In known bodymakers for the production of thin-walled metal cans by the so-called "drawing and wall-ironing" (DWI) process, cups are fed to the bodymaker and carried by a punch on the end of a ram through a series of dies to obtain the desired size and thickness of the can. The series of dies may include a redraw die for reducing the diameter of the cup and lengthening its sidewall, and one or more ironing dies for wall-ironing a cup into a can body. Ultimately, the can body carried on the punch may contact a bottom forming tool so as to form a shape such as a dome on the base of the can. An exemplary bodymaker is described in WO9934942.

For the DWI process to be successful, it is essential that a cup supplied to the bodymaker is positioned accurately in the path of the punch and held in place while the punch draws the base of the cup through the redraw die. In existing bodymakers, this is achieved by precise alignment of a cup locator on the front of the bodymaker cradle with a redraw sleeve mounted on the front of a reciprocating redraw carriage. Prior to the punch contacting the cup, the redraw sleeve enters the cup and forces the base of the cup against the redraw die. Misalignment of the redraw carriage may cause incorrect positioning of the cup with respect to the punch and the redraw die, leading to damage or reduced uniformity in the produced cans, particularly for thin-walled metal cans. Such misalignment may also increase wear on or damage the machine components.

Alignment of known bodymakers is a time consuming process which requires production to be halted. The high volume nature of the can industry means that lost production time can be very costly for can producers. Additionally, alignment procedures for known bodymakers require significant skill and attention to ensure that the machines can be operated safely and efficiently.

SUMMARY OF THE INVENTION

According to a first aspect of the present invention there is provided a can bodymaker comprising a ram and a redraw sleeve assembly for holding a cup or other preform article against a redraw die. The redraw sleeve assembly comprises: a redraw sleeve; a redraw carriage to which the redraw sleeve is removably coupled, the redraw carriage being driven in a reciprocating motion along an axis; and a redraw sleeve alignment mechanism. The redraw sleeve alignment mechanism comprises: a redraw sleeve module having one or more bearings defining a passage through which the redraw sleeve moves and a bearing adjustment mechanism to facilitate radial alignment of the redraw sleeve module with the redraw die. The coupling between the redraw carriage and the redraw sleeve permits variable radial offset, relative to said axis, between the two components.

A preform article includes any article suitable for producing can bodies through a DWI process. During the drawing part of the DWI process, the redraw sleeve is pushed into the cup or preform article by the redraw carriage so that the base of the can or preform article is held against the redraw die. The redraw sleeve is hollow to allow the ram to pass through.

The bodymaker may comprise a magnetic coupling for coupling the redraw carriage and the redraw sleeve.

The redraw sleeve alignment mechanism may comprise a redraw sleeve module housing fixed relative to the can bodymaker, the redraw sleeve module being located within the redraw sleeve module housing whereby said bearing adjustment mechanism permits radial positioning of the redraw sleeve module within the redraw sleeve module housing.

The bearing adjustment mechanism may comprise one or more cams attached to the redraw sleeve module housing. The or each cam may be coupled to a rod extending coaxially through the redraw sleeve module housing and being accessible via a surface of the redraw sleeve module housing opposed to the redraw carriage, rotation of the or each rod causing rotation of the associated cam.

The one or more bearings of the redraw sleeve module may be fixed within a substantially cylindrical frame and the substantially cylindrical frame located within said redraw sleeve module housing. The bearing adjustment mechanism permits radial positioning of the redraw sleeve module by moving the cylindrical frame within the redraw sleeve module housing. The one or more bearings of the redraw sleeve module may comprise a pair of bearings, each bearing being located within the cylindrical frame. The cylindrical frame may comprise a circumferential groove for supplying lubricant to the redraw sleeve, the groove being located between the pair of bearings. The redraw sleeve module may comprise a pair of lip seals attached to the cylindrical frame and located on, respective, opposite sides of the pair of bearings.

The redraw sleeve alignment mechanism may comprise a bracket fixed to the can bodymaker, the redraw sleeve module housing being fixed to the can bodymaker by means of the bracket. The redraw sleeve alignment mechanism may further comprise a locator for holding and locating a cup or other preform article in front of the redraw sleeve. The locator is coupled to the bracket and the bracket has a locator adjustment mechanism to facilitate radial alignment of the locator within the bracket.

The locator adjustment mechanism may comprise one or more cams attached to the bracket. The or each cam of the locator adjustment mechanism may be coupled to a rod extending coaxially through the bracket and being accessible via a surface of the redraw sleeve module housing opposed to the redraw carriage. Rotation of the or each rod causes rotation of the associated cam.

According to a second aspect of the present invention there is provided a method of setting up a can bodymaker. The method comprises the steps of: providing a redraw sleeve module for supporting a redraw sleeve; moving the bearing to align the redraw sleeve radially with respect to a redraw die attached to the bodymaker, and fixing the redraw sleeve module in place; and coupling the redraw sleeve to a redraw carriage of the bodymaker.

The method may further comprise locating the redraw sleeve within the redraw sleeve module either before or after the step of moving the redraw bearing.

The step of moving the redraw sleeve module may comprise rotating one or more cams acting against the redraw sleeve module. The redraw sleeve module may be located within a redraw sleeve module housing. The or each cam acts between the redraw sleeve module housing and the redraw sleeve module.

The method may further comprise providing a locator for a cup or other preform article within a bracket fixed to the redraw sleeve module housing, and moving the locator radially within the bracket to align the locator with respect to the redraw die.

According to a third aspect of the present invention there is provided a redraw sleeve alignment mechanism for use with a can bodymaker. The redraw sleeve alignment mechanism configured to align a redraw sleeve with a redraw die and comprises: a redraw sleeve module having one or more bearings defining a passage through which the redraw sleeve moves; and a bearing adjustment mechanism to facilitate radial alignment of the redraw sleeve module with the redraw die.

The redraw sleeve alignment mechanism may comprise a redraw sleeve module housing for coupling to the can bodymaker in a fixed position. The redraw sleeve module is located within the redraw sleeve module housing whereby the bearing adjustment mechanism permits radial positioning of the redraw sleeve module within the redraw sleeve module housing.

The redraw sleeve alignment mechanism may comprise a bracket for coupling the redraw sleeve module housing to the can bodymaker in a fixed position.

The redraw sleeve alignment mechanism may comprise a locator for holding and locating a cup or other preform article in front of the redraw sleeve. The locator is coupled to the bracket and the bracket has a locator adjustment mechanism to facilitate radial alignment of the locator within the bracket.

According to a fourth aspect of the present invention there is provided a toolpack module for use with a can bodymaker. The toolpack module comprises: a frame; a redraw die coupled to the frame; and a redraw sleeve alignment mechanism according to the third aspect of the present invention. The redraw sleeve alignment mechanism is coupled to the frame.

DETAILED DESCRIPTION

In order to address the problems associated with aligning the redraw sleeve of the conventional bodymaker, it is proposed here to enable a temporary decoupling of the redraw sleeve from the redraw carriage. Moreover, recoupling between the redraw sleeve and the redraw carriage allows for radial misalignment of the redraw carriage and the redraw sleeve. In practice, this means that there is no need for a fine alignment of the redraw carriage with the redraw die. Only the redraw sleeve needs to be so aligned, and this can be carried out relatively easily.

Figure 1:
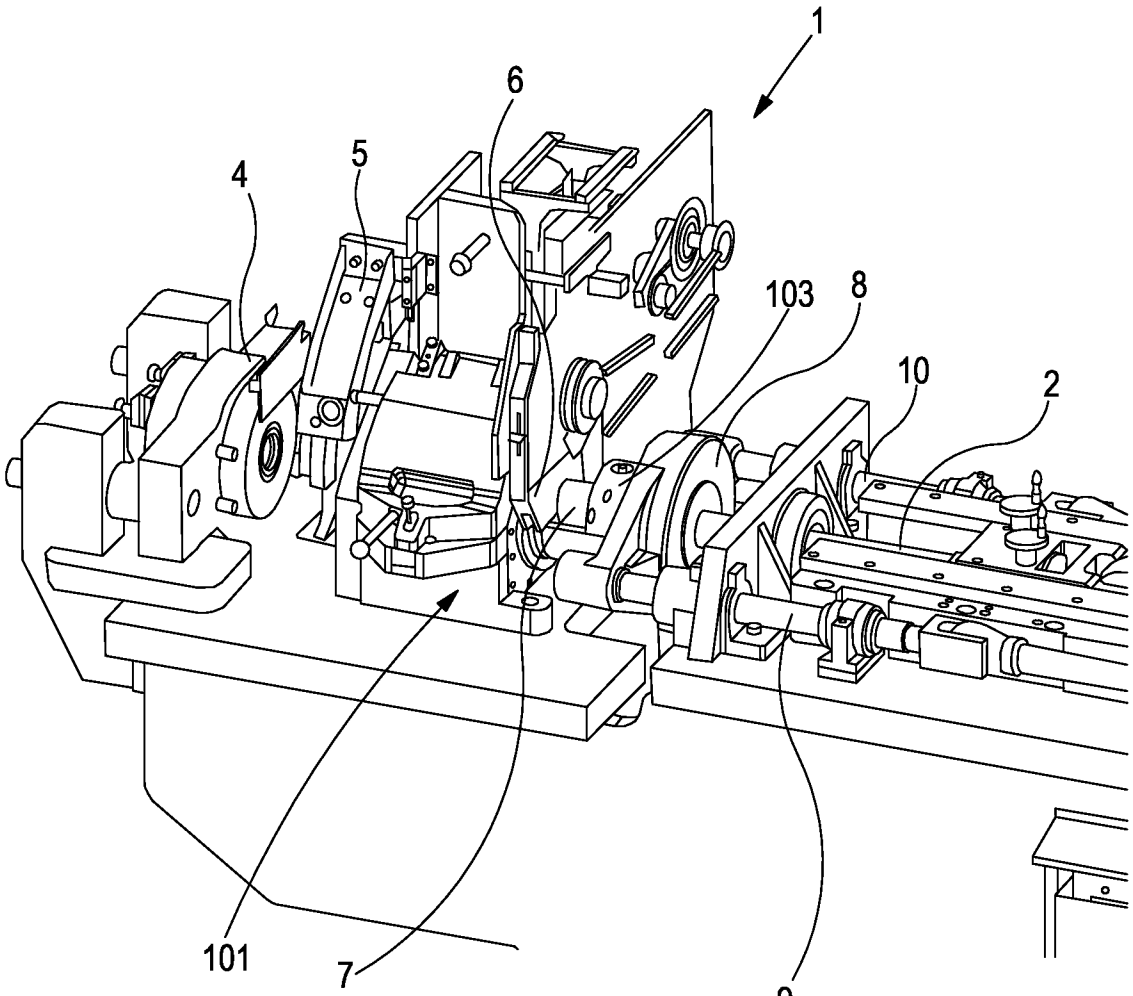
FIG. 1 is a perspective schematic view of a bodymaker according to an embodiment of the invention.

FIG. 1 shows a perspective schematic view of a bodymaker 1 for making can bodies from cups drawn from sheet metal. The bodymaker 1 comprises a reciprocating ram 2 with a punch (not shown) mounted on one end. During a forward stroke of the ram 2, the punch contacts a cup (not shown) held in the path of the ram by a redraw sleeve assembly 3 attached to a toolpack module 101. The punch pushes the cup through a redraw die (not shown) to form an elongated cup body. The elongated cup body is carried on the punch through one or more ironing dies, housed within the toolpack module 101, to further elongate and thin the cup body before finally contacting a bottom forming tool or "domer" 4 so as to form a shape such as dome on the base. On a return stroke of the ram 2, the formed can body is removed from the punch and transported away from the ram axis by a can discharge turret 5.

The redraw sleeve assembly 3 comprises a redraw sleeve 7, a redraw carriage 8 and a redraw sleeve alignment mechanism 103 for aligning the redraw sleeve 7 with the one or more ironing dies. The cup is supplied to the redraw sleeve assembly 3 by an infeed mechanism 6 located above the ram 2. The cup is held in position during the redraw process by a generally hollow cylindrical redraw sleeve 7 which is aligned coaxially with the ram 2 and has a central bore which allows the punch to pass therethrough. A rear end of the redraw sleeve 7 is coupled to a redraw carriage 8 which is driven in a reciprocating motion by a pair of push rods 9, 10 located on opposite sides of the ram 2. A cup locator (not shown) mounted on the redraw sleeve alignment mechanism 103 receives the cup while the punch and the redraw sleeve 7 are in a retracted position with respect to the redraw sleeve assembly 3. During the forward stroke of the ram 2, prior to the punch contacting the cup, the redraw sleeve 7 enters the open end of the cup and forces the cup into contact with the redraw die. The redraw sleeve 7 holds the cup against the redraw die as the punch pushes the base of the cup through an aperture of the redraw die which is of smaller diameter than the cup. As the cup is drawn through the redraw die by the punch, the cup reduces in diameter and its sidewall lengthens. The elongated cup is then carried away from the redraw assembly 3 by the punch.

Figure 2:
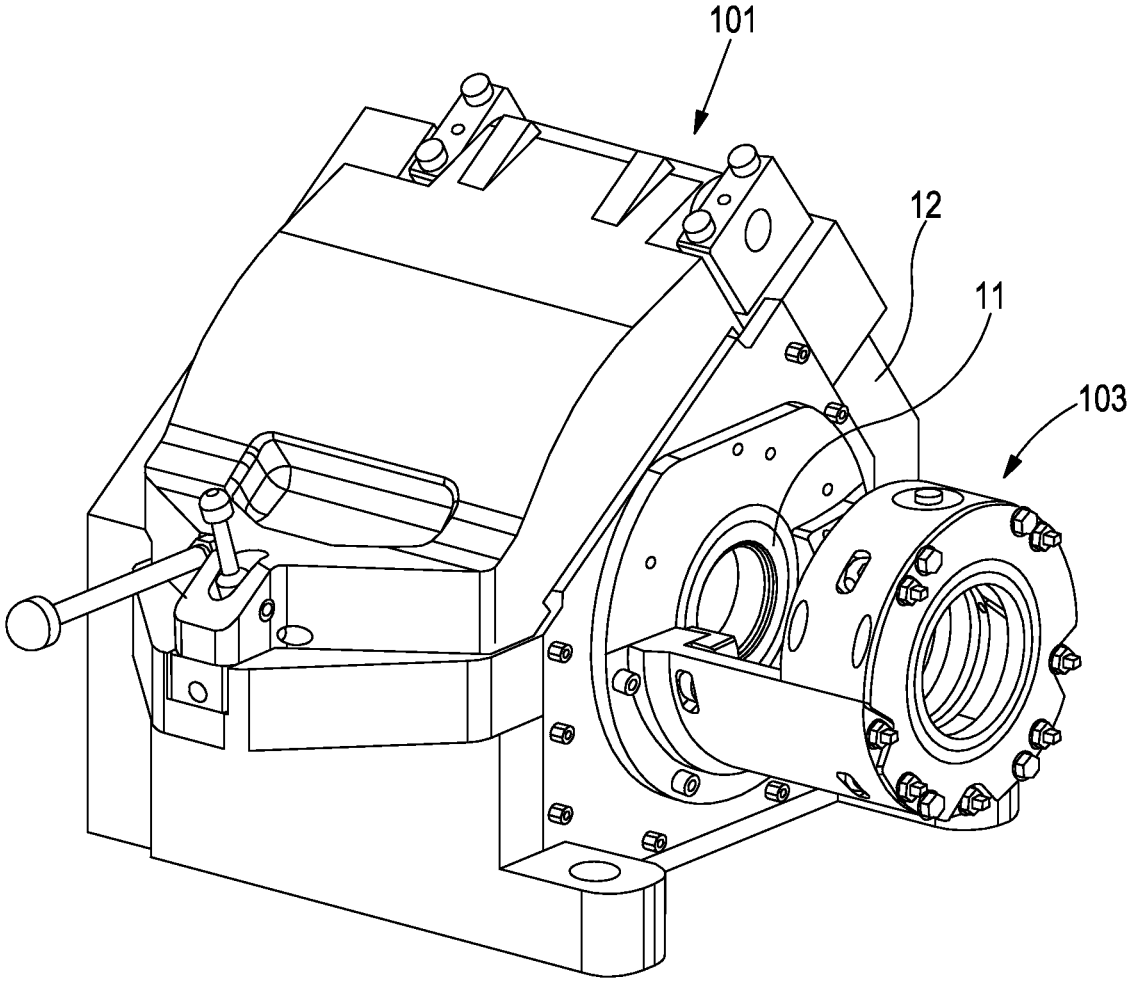
FIG. 2 is a perspective schematic view of the toolpack module including the redraw sleeve alignment mechanism shown in FIG. 1.

FIG. 2 is a perspective schematic view of the toolpack module 101 including the redraw sleeve alignment mechanism 103 attached to its front face. Note that the redraw sleeve 7 is not shown in FIG. 2. The redraw die 11 is held rigidly in place within a bodymaker cradle 12 of the toolpack module 101.

Figure 3:
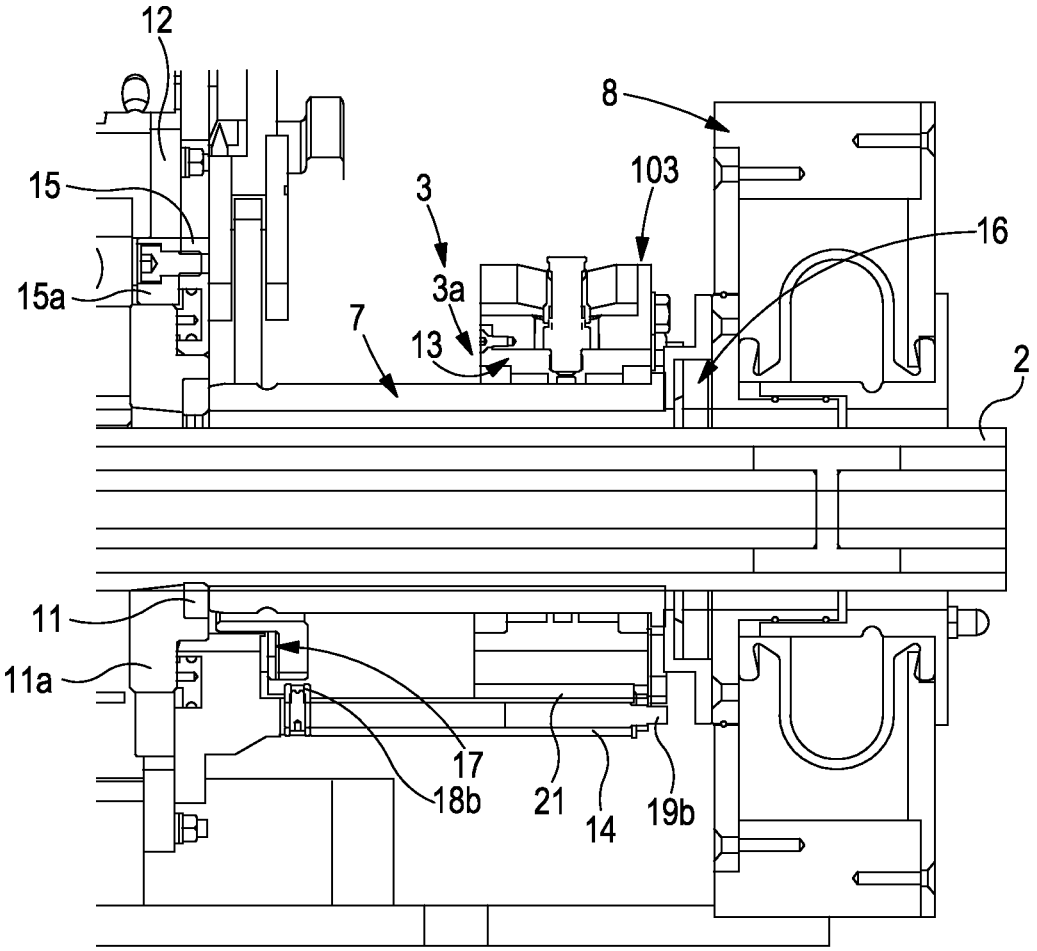
FIG. 3 is a vertical section schematic view through the redraw sleeve assembly shown in FIG. 1.

FIG. 3 shows a vertical section schematic view through the redraw sleeve assembly 3 shown in FIG. 1, after the redraw process has been completed.

Figure 4:
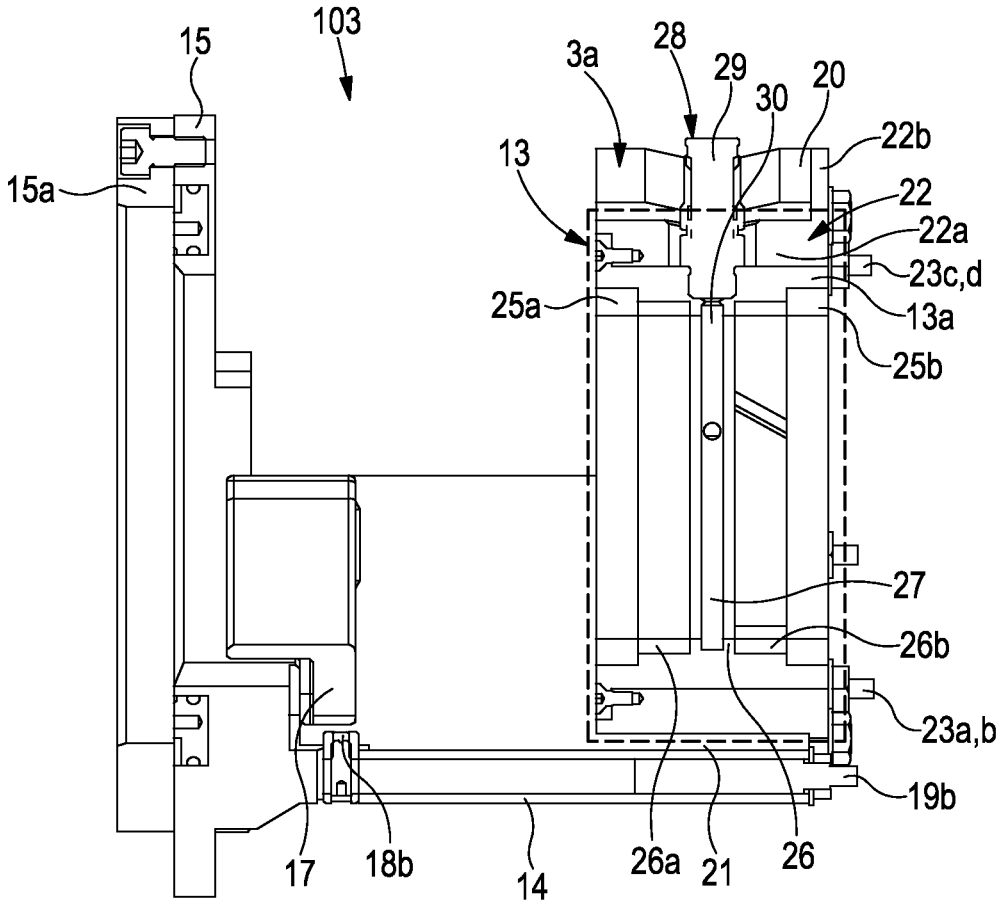
FIG. 4 is a section schematic view of the redraw sleeve alignment mechanism shown in FIGS. 1, 2 and 3.
Figure 5:
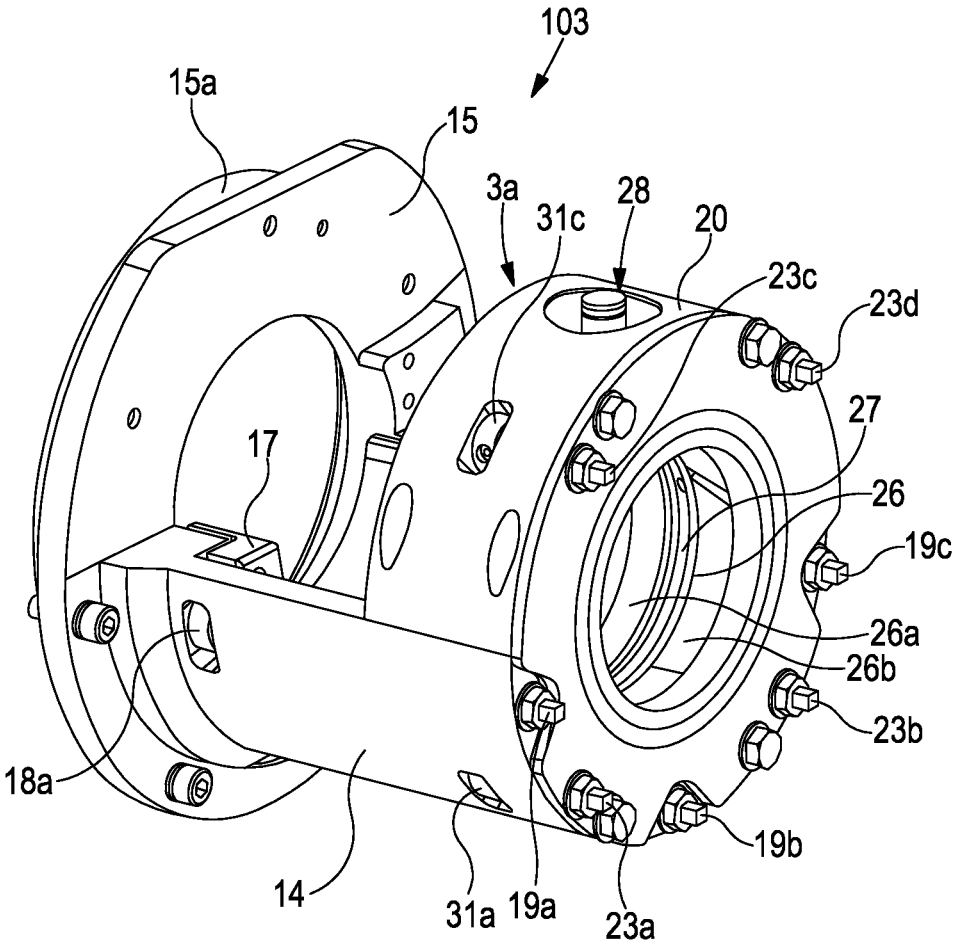
FIG. 5 is a perspective schematic view of the redraw sleeve alignment mechanism shown in FIGS. 1 to 4.

FIGS. 4 and 5 show, respectively, a vertical section schematic view and a perspective schematic view of the redraw sleeve alignment mechanism 103 shown in FIGS. 1, 2 and 3. Certain features of the redraw sleeve alignment mechanism 103 may be more clearly understood by reference to two or more of the Figures simultaneously.

In the configuration shown in FIG. 3, the punch has passed through the redraw sleeve assembly 3 pushing the cup with it, and the (leftmost end of the) redraw sleeve 7 is now in contact with the annular redraw die 11, and in particular with a redraw die insert 11*a*. The redraw sleeve 7 is supported within the redraw sleeve alignment mechanism 103 which comprises a generally cylindrical redraw sleeve module 13 (see the dashed box shown in FIG. 4) and a module housing 3*a*. The radial position of the redraw sleeve module 13 within the module housing 3*a* can be adjusted as discussed below.

The redraw sleeve module 13 maintains the alignment of the redraw sleeve 7 with respect to the redraw die 11 as the redraw sleeve 7 moves backwards and forwards in synchronisation with the ram 2. The rear end of the redraw sleeve 7 is coupled to the redraw carriage 8 so that the linear motion of the redraw carriage 8 is transferred efficiently to the redraw sleeve 7.

The redraw sleeve 7 may be detached from the redraw carriage 8 so that the redraw sleeve can be aligned independently of the redraw carriage 8. The coupling between the redraw sleeve 7 and the redraw carriage 8 does not require the redraw carriage 8 and the redraw sleeve 7 to be precisely aligned, i.e., the redraw carriage 8 may be radially misaligned with respect to the axis of the redraw sleeve 7. This flexibility means that it is no longer necessary to align the redraw carriage 8 precisely as the redraw sleeve 7 is now guided by and aligned within the redraw sleeve module 13.

The redraw sleeve 7 is coupled to the redraw carriage 8 using a coupling means that allows the two components to move together axially but which allows for relative axial movement. In one embodiment, strong magnets 16 are fixed to the rear (rightmost) end of the redraw sleeve 7 to engage with the opposed surfaces of the redraw carriage 8. The magnets 16 and the opposed surfaces may be flat in order to facilitate coupling across a range of radial positions. Other coupling mechanisms can of course be contemplated. For example, the coupling mechanism may be an adjustable clutch or a flexible joint, e.g. a ball and socket joint.

In use, the redraw sleeve 7 moves through the redraw sleeve module 13 to force a cup into contact with the redraw die. The cup is received by the cup locator 17 mounted on the end of the redraw sleeve alignment mechanism 103 adjacent to the redraw die. The cup locator 17 can be seen more clearly in the perspective view of FIG. 5. The cup locator 17 has a semi-circular cross-section with an inner diameter which is of a slightly larger diameter than the outer diameter of the cup and is arranged to be upward facing so that a cup may drop into position from above. The cup locator 17 is supported by three eccentric cams 18*a-c* (two cams not shown) housed within a bracket 14 of semi-circular cross-section. The radial position of the cup locator 17 with respect to the redraw die may be adjusted by rotating each of the eccentric cams 18*a-c* using a set of three square rods 19*a-c* extending through the bracket 14.

As shown in FIGS. 4 and 5, the module housing 3*a* comprises an end of the bracket 14, the other end of which is attached to the cradle 12 by a pair of opposed flanges 15, 15*a* which are bolted together and which each have a cylindrical bore for receiving the redraw die 11 and the ram 2. The module housing 3*a* further comprises a bridge 20 (see FIG. 5) with a semi-circular cross-section and which is fixed to the end of the bracket 14 by means of vertically extending bolts (not shown). The bridge 20 has approximately the same inner and outer diameter as the bracket 14, so as to provide a generally cylindrical passage 21 (see FIG. 4) for receiving the bearing 13.

The structure of the redraw sleeve alignment mechanism 103 is best shown in the vertical section view of FIG. 4. The redraw sleeve 7 is not shown in this Figure. The redraw sleeve module 13, which is fitted within the module housing 3*a*, comprises a cylindrical bearing frame 13*a* located within a bearing support cylinder 22. The bearing support cylinder 22 has a cylindrical body 22*a* and a flange 22*b* which extends radially outwards from one end of the body 22*a*. The outer diameter of the body 22*a* is smaller than the inner diameter of the passage 21 through the module housing 3*a*, resulting in a gap between these components to allow the body 22*a* to be positioned within the passage 21 and its radial position adjusted. As shown in the perspective view of FIG. 5, the outer diameter of the flange 22*b* is of substantially the same outer diameter as the module housing 3*a* to allow the flange to be bolted against the (rightmost) end of the module housing 3*a* once the bearing support cylinder 22 has been aligned.

The bearing support cylinder 22 may be aligned radially within the module housing 3*a* by adjusting a set of four eccentric cams 31*a-d* (see FIG. 5, two cams not shown) which protrude radially into the passage 21 to contact the outer surface of the bearing support cylinder 22. The four cams 31*a-d* are positioned around the circumference of the passage 21, with a lower pair 31*a,b* of the cams housed in the bracket 14 and an upper pair 31*c,d* housed in the bridge 20. Each cam 31*a-d* is fixed to a rod 23*a-d* of square cross section which protrudes from the end of the module housing 3*a*. Turning the rods 23*a-d* causes the eccentric cams 31*a-d* to rotate against the bearing support cylinder 22, thereby allowing the radial position of the bearing support cylinder 22 within the passage 21 to be varied.

The vertical section view of FIG. 4 shows the cylindrical bearing frame 13*a*, which is bolted to the bearing support cylinder 22 to form a single unit in which the two components remain locked together in fixed alignment. A ring 26 projects inwardly from the bearing frame 13*a* around halfway along its length. Two cylindrical bearings 26*a,b* are housed within the cylindrical bearing frame 13*a*, one on either side of the ring 26. The bearings 26*a,b* may, for example, be bushings made from PTFE or another low-friction polymer. The ring 26 is slightly recessed with respect to the bearings 26*a,b* to allow the redraw sleeve 3 to be supported by the bearings 26*a,b*. Using more than one cylindrical bearing 26*a,b* may improve the stability of the redraw sleeve as it moves through the redraw sleeve module 13. A circumferential groove 27 is provided in the ring 26 to receive a lubricant such as oil. In use, lubricant from the groove 27 is deposited on the outer surface of the redraw sleeve 7 to reduce friction as the redraw sleeve 7 moves backwards and forwards through the bearings 26*a,b*. The bearing frame 13*a* has fixed within it a pair of cylindrical lip seals 25*a,b*, one at each end of the frame, for forming a seal against the outer surface of the redraw sleeve 3 so that the lubricant does not leak from the bearing frame 13*a*.

A cylindrical bore is provided radially through the top of each of the bridge 20 and the bearing locator 22 to accommodate a lubricating device 28 (the top of which is also visible in FIG. 5) for dispensing a lubricant into the circumferential groove 27. The lubricating device 28 comprises a capped reservoir 29 for containing the lubricant and a dispensing end 30 which allows the lubricant to leak gradually from a small aperture when the bodymaker 1 is in use. The dispensing end 30 is screwed into the bearing 13 so that the small aperture adjoins a hole in the circumferential groove 27 to allow the lubricant to flow therethrough.

Although the bearing frame 13*a* has been described as comprising a pair of lubricated bearings 26*a,b*, it will be appreciated that alternative components for reducing mechanical friction can be used, e.g. the redraw sleeve may be supported by a linear bearing comprising ball bearings or a set of rollers.

The redraw sleeve alignment mechanism 103 may also be used in a modular can bodymaker. For example, the redraw sleeve alignment mechanism 13 may form part of a toolpack module 101 that can be removed from the can bodymaker. Such a toolpack module 101 can be attached to an alignment bed to allow alignment of the redraw sleeve module 13 with respect to the components housed within the toolpack module (such as the redraw die). Once the toolpack module 101 has been aligned, it can be replaced precisely in its original position on the machine bed of the can bodymaker.

Figure 6:
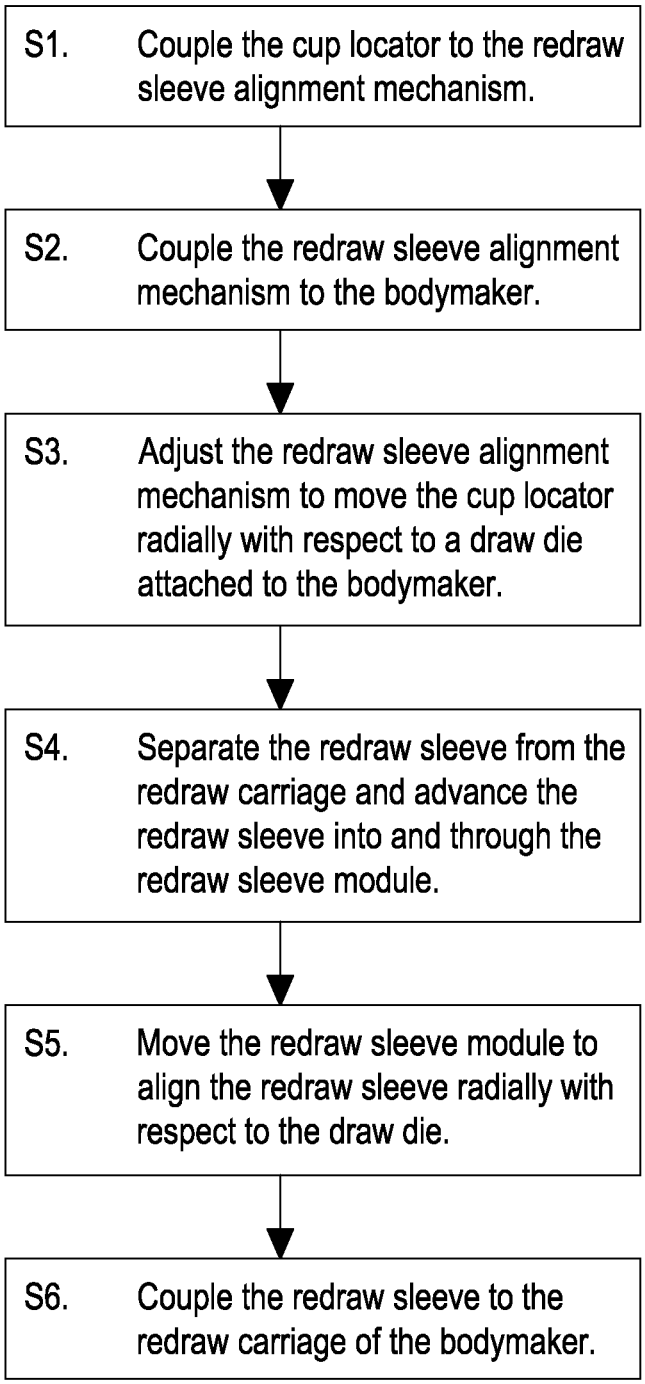
FIG. 6 is a flow chart illustrating a method of setting up the bodymaker of FIG. 1.

FIG. 6 is a flow diagram illustrating a method of setting up the bodymaker 1 of FIG. 1. The first step of the method 51 is to fix the cup locator 17 to the redraw sleeve alignment mechanism 103 and then, with the redraw sleeve 7 and ram 2 fully retracted, to fix S2 the redraw sleeve alignment mechanism 103 with attached cup locator 17 into the bodymaker 1. Using the rods 19*a-c*, the cup locator 17 is adjusted S3 radially with respect to the redraw die 11 attached to the bodymaker 1. Next, the redraw sleeve 7 is separated from the redraw carriage, e.g. by separating the magnetic couplings, and advanced into and through the redraw sleeve module S4. The rods 23*a-d* are then adjusted S5 to align the redraw sleeve 7 radially with respect to the redraw die, whereupon the redraw sleeve is pushed into and through the redraw bearing. Alternatively, the redraw sleeve 7 may be advanced into and through the redraw sleeve module 13 after the redraw sleeve module 13 has been aligned with respect to the redraw die. The redraw sleeve 7 and the redraw carriage 8 are then re-coupled S6. It will be appreciated that this recoupling is made possible because it allows for relative radial movement of the redraw sleeve 7 and the redraw carriage 8.

It will be understood by the person of skill in the art that various modifications may be made to the above described embodiments without departing from the scope of the present invention.

Table of components referred to in the description

| Component | Reference numeral(s) |
|---|---|
| Can bodymaker | 1 |
| Ram | 2 |
| Redraw sleeve assembly | 3 |
| Redraw sleeve alignment mechanism | 103 |
| Redraw sleeve module housing | 3a |
| Bottom forming tool | 4 |
| Can discharge turret | 5 |
| Infeed mechanism | 6 |
| Redraw sleeve | 7 |
| Redraw carriage | 8 |
| Push rods | 9, 10 |
| Redraw die | 11 |
| Toolpack module | 101 |
| Bodymaker cradle | 12 |
| Redraw sleeve module | 13 |
| Cylindrical bearing frame | 13a |
| Bracket | 14 |
| Opposed flanges | 15, 15a |
| Magnets | 16 |
| Cup locator | 17 |
| Eccentric cams | 18a-c |
| Sguare rods | 19a-c |
| Bridge | 20 |
| Passage | 21 |
| Bearing support cylinder | 22 |
| Bearing support cylinder body | 22a |
| Bearing support cylinder flange | 22b |

-continued

Table of components referred to in the description

| Component | Reference numeral(s) |
|---|---|
| Rods | 23a-d |
| Lip seals | 25a, b |
| Ring | 26 |
| Bearings | 26a, b |
| Circumferential groove | 27 |
| Lubricating device | 28 |
| Capped reservoir | 29 |
| Dispensing end | 30 |
| Eccentric cams | 31a-d |

The invention claimed is:

1. A can bodymaker comprising a ram and a redraw sleeve assembly for holding a cup or other preform article against a redraw die, the redraw sleeve assembly comprising:

a redraw sleeve;

a redraw carriage to which the redraw sleeve is removably coupled, the redraw carriage being driven in a reciprocating motion along an axis; and a redraw sleeve alignment mechanism comprising:

a redraw sleeve module having one or more bearings defining a passage through which the redraw sleeve moves; and a bearing adjustment mechanism to facilitate radial alignment of the redraw sleeve module with the redraw die;

wherein the coupling between the redraw carriage and the redraw sleeve permits variable radial offset, relative to said axis, between the two components.

2. The can bodymaker according to claim 1 and comprising a magnetic coupling for coupling the redraw carriage and the redraw sleeve.

3. The can bodymaker according to claim 1, the redraw sleeve alignment mechanism comprising a redraw sleeve module housing fixed relative to the can bodymaker, the redraw sleeve module being located within the redraw sleeve module housing whereby said bearing adjustment mechanism permits radial positioning of the redraw sleeve module within the redraw sleeve module housing.

4. The can bodymaker according to claim 3, wherein the bearing adjustment mechanism comprises one or more cams attached to the redraw sleeve module housing.

5. The can bodymaker according to claim 4, wherein each of the one or more cams is coupled to a rod extending coaxially through the redraw sleeve module housing and being accessible via a surface of the redraw sleeve module housing opposed to the redraw carriage, rotation of each rod causing rotation of the associated cam.

6. The can bodymaker according to claim 3, wherein the one or more bearings of the redraw sleeve module are fixed within a substantially cylindrical frame and the substantially cylindrical frame is located within said redraw sleeve module housing, and whereby said bearing adjustment mechanism permits radial positioning of the redraw sleeve module by moving the cylindrical frame within the redraw sleeve module housing.

7. The can bodymaker according to claim 6, wherein the one or more bearings of the redraw sleeve module comprise a pair of bearings.

8. The can bodymaker according to claim 7, wherein the cylindrical frame comprises a circumferential groove for supplying lubricant to the redraw sleeve, the groove being located between the pair of bearings.

9. The can bodymaker according to claim 7, wherein the redraw sleeve module comprises a pair of lip seals attached to respective ends of the cylindrical frame in order to isolate the bearings.

10. The can bodymaker according to claim 3, the redraw sleeve alignment mechanism further comprising a bracket fixed to the can bodymaker, the redraw sleeve module housing being fixed to the can bodymaker by means of the bracket.

11. The can bodymaker according to claim 10, the redraw sleeve alignment mechanism further comprising a locator for holding and locating a cup or other preform article in front of the redraw sleeve, the locator being coupled to the bracket and the bracket having a locator adjustment mechanism to facilitate radial alignment of the locator within the bracket.

12. The can bodymaker according to claim 11, wherein said locator adjustment mechanism to facilitate radial alignment of the locator comprises one or more cams attached to the bracket.

13. The can bodymaker according to claim 12, wherein each of the one or more cams of the locator adjustment mechanism is coupled to a rod extending coaxially through the bracket and being accessible via a surface of the redraw sleeve module housing opposed to the redraw carriage, rotation of each rod causing rotation of the associated cam.

14. A redraw sleeve alignment mechanism for use with a can bodymaker, the redraw sleeve alignment mechanism configured to align a redraw sleeve with a redraw die and comprising:

a redraw sleeve module having one or more bearings defining a passage through which the redraw sleeve moves; and a bearing adjustment mechanism to facilitate radial alignment of the redraw sleeve module with the redraw die.

15. The redraw sleeve alignment mechanism according to claim 14 and comprising a redraw sleeve module housing for coupling to the can bodymaker in a fixed position, the redraw sleeve module being located within the redraw sleeve module housing whereby said bearing adjustment mechanism permits radial positioning of the redraw sleeve module within the redraw sleeve module housing.

16. The redraw sleeve alignment mechanism according to claim 15 and comprising a bracket for coupling the redraw sleeve module housing to the can bodymaker in a fixed position.

17. The redraw sleeve alignment mechanism according to claim 16 and comprising a locator for holding and locating a cup or other preform article in front of the redraw sleeve, the locator being coupled to the bracket and the bracket having a locator adjustment mechanism to facilitate radial alignment of the locator within the bracket.

18. A toolpack module for use with a can bodymaker, the toolpack module comprising:

a frame;

a redraw die coupled to the frame; and a redraw sleeve alignment mechanism according to claim 14, the redraw sleeve alignment mechanism being coupled to the frame.

* * * * *